US011417479B2

(12) United States Patent
Cernat et al.

(10) Patent No.: US 11,417,479 B2
(45) Date of Patent: Aug. 16, 2022

(54) ARRANGEMENT AND METHOD FOR SWITCHING HIGH CURRENTS IN HIGH-, MEDIUM- AND/OR LOW-VOLTAGE ENGINEERING

(71) Applicant: Siemens Energy Global GmbH & Co. KG, Munich (DE)

(72) Inventors: Radu-Marian Cernat, Berlin (DE); Thomas Chyla, Berlin (DE); Prosper Hartig, Berlin (DE); Caroline Orth, Berlin (DE); Christoph Roehling, Berlin (DE); Joerg Teichmann, Dallgow-Doeberitz (DE); Stephan Wethekam, Berlin (DE); Stefan Giere, Berlin (DE); Sylvio Kosse, Erlangen (DE); Andreas Marth, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/647,594

(22) PCT Filed: Aug. 20, 2018

(86) PCT No.: PCT/EP2018/072393

§ 371 (c)(1),
(2) Date: Mar. 16, 2020

(87) PCT Pub. No.: WO2019/052778

PCT Pub. Date: Mar. 21, 2019

(65) Prior Publication Data

US 2020/0279703 A1 Sep. 3, 2020

(30) Foreign Application Priority Data

Sep. 14, 2017 (DE) ..... 102017216275

(51) Int. Cl.
*H01H 33/12* (2006.01)
*H01H 33/42* (2006.01)
*H01H 33/666* (2006.01)

(52) U.S. Cl.
CPC ..... *H01H 33/125* (2013.01); *H01H 33/42* (2013.01); *H01H 33/6661* (2013.01)

(58) Field of Classification Search
CPC .... H01H 33/125; H01H 33/122; H01H 33/42; H01H 33/143; H01H 33/6661; H01H 33/128; H01H 1/385; H01H 33/66
(Continued)

(56) References Cited

U.S. PATENT DOCUMENTS 2,480,622 A * 8/1949 Warnock ..... H01H 33/126 218/12
3,560,682 A * 2/1971 Kohler ..... H01H 33/122 218/10

(Continued)

FOREIGN PATENT DOCUMENTS

CN 11225996 A 7/1996
CN 102034640 A 4/2011

(Continued)

*Primary Examiner* — William A Bolton
(74) *Attorney, Agent, or Firm* — Laurence A. Greenberg; Werner H. Sterner; Ralph E. Locher

(57) ABSTRACT

An arrangement and a method for switching high currents include at least one vacuum switching path and at least one rated-current contact switching path. The at least two switching paths are electrically connected in parallel. One current path for a rated current is routed over at least one rated-current contact of said rated-current contact switching path, and a parallel current path for a short-circuit current is routed over at least one contact of a vacuum tube of the vacuum switching path.

18 Claims, 3 Drawing Sheets

(58) Field of Classification Search
USPC ..... 218/6–11, 152, 16, 13; 200/51.11, 400, 200/120
See application file for complete search history.

(56) References Cited

U.S. PATENT DOCUMENTS 3,671,696 A * 6/1972 Brunner ..... H01H 33/12 218/10
3,824,359 A * 7/1974 Date ..... H01H 33/127 218/10
4,072,392 A * 2/1978 McConnell ..... H01H 1/385 439/851
4,393,290 A 7/1983 Mittelbach et al.
4,426,561 A * 1/1984 Berkebile ..... H01H 33/703 218/59
4,538,039 A * 8/1985 Gotoh ..... H01H 33/12 218/10
5,155,315 A * 10/1992 Malkin ..... H01H 33/122 218/3
5,663,544 A 9/1997 Niemeyer
5,905,242 A * 5/1999 Bernard ..... H01H 33/6661 218/154
6,593,538 B2 * 7/2003 Perret ..... H01H 33/143 218/3
8,901,447 B2 12/2014 Manzoni et al.
9,177,740 B2 11/2015 Mantilla et al.
2009/0095716 A1 4/2009 Einschenk

FOREIGN PATENT DOCUMENTS

CN 103119677 A 5/2013
DE 2522525 A1 12/1976
DE 102006023372 A1 11/2007
EP 0016983 A1 10/1980
FR 2611310 A1 8/1988

* cited by examiner

ARRANGEMENT AND METHOD FOR SWITCHING HIGH CURRENTS IN HIGH-, MEDIUM- AND/OR LOW-VOLTAGE ENGINEERING

BACKGROUND OF THE INVENTION

Field of the Invention

The invention relates to an arrangement and a method for switching high currents, having at least one vacuum switching path and at least one rated-current contact switching path.

The optimization of electrical switching devices of high current ratings, particularly in the region of a few hundred amperes, is executed with reference to various performance parameters. Performance parameters for circuit-breakers include e.g. the low-loss conduction of a rated current and the switching of the largest possible rated currents and short-circuit currents. Where vacuum tubes are employed as circuit-breakers, the transmission of a rated current and the switching of currents is executed by means of the same contact system, which is arranged within a vacuum. An optimization is executed between these functions, wherein the parameters of the optimized circuit-breaker invariably constitute a compromise with respect to one function.

SUMMARY OF THE INVENTION

The object of the present invention is the disclosure of an arrangement and a method for switching high currents in high-, medium- and/or low-voltage engineering. In particular, the object is to permit the simple and cost-effective separation of the functions of current-carrying capability and switching, particularly of short-circuit currents.

According to the invention, the object indicated is fulfilled by an arrangement for switching high currents, having the features recited below, and/or by a method for switching high currents in low-, medium- and/or high-voltage engineering, in particular by means of an above-mentioned arrangement, having the steps recited below. Advantageous configurations of the arrangement according to the invention for switching high currents and/or of the method for switching high currents in low-, medium- and/or high-voltage engineering, in particular by means of an above-mentioned arrangement, are disclosed in the sub-claims. The objects of the main claims are mutually combinable, and combinable with characteristics of the sub-claims, and characteristics of the sub-claims are mutually combinable.

An arrangement according to the invention for switching high currents comprises at least one vacuum switching path and at least one rated-current contact switching path. The at least two switching paths are electrically connected in parallel.

By the parallel electrical connection of the switching paths, separation of the functions of current-carrying capability and switching, particularly of short-circuit currents, is possible in a simple and cost-effective manner. The rated-current contact switching path can be optimally designed for a high current-carrying capability, and switching, particularly of short-circuit currents, can be executed by means of the vacuum switching path. The vacuum switching path can be optimized for switching short-circuit currents, without being designed for a high current-carrying capability.

The at least one vacuum switching path can comprise at least one vacuum tube. The rated-current contact switching path can comprise at least one rated-current contact, in particular a cylindrical rated-current contact having at least two contact points, wherein at least one contact point can be arranged in a moveable manner. The at least one vacuum tube can be optimized, particularly for the switching of short-circuit currents and, in particular, without a high current-carrying capability. The at least one rated-current contact can show a high current-carrying capability. By the parallel electrical connection of the at least one rated-current contact and the at least one vacuum tube, switching of the arrangement can be executed, wherein the arrangement, in the closed state, shows a high current-carrying capability.

The rated-current contact can be constituted of a metal and/or can incorporate a metal, particularly aluminum, steel, copper, silver and/or metallic alloys, particularly incorporating aluminum, steel, copper and/or silver. Metallic contacts which incorporate aluminum, steel, copper and/or silver show good conductivity, with a low specific resistance. Consequently, a high current-carrying capability across the rated-current contact is possible, with the contact in the closed state.

The at least one rated-current contact switching path can show a lower contact resistance than the vacuum switching path. In particular, by the configuration of electrodes or contact points in a vacuum, the vacuum switching path and the current-carrying capability thereof are particularly optimized for the switching of short-circuit currents. These are of a short-term nature only and, essentially, it is required that the occurrence and maintenance of arcs should be suppressed. To this end, contact points of particular shapes may be preferred, particularly having plate-shaped contact surfaces which e.g. incorporate regular gaps on the surface for the conduction of arcs. Materials having a high specific resistance, e.g. steel, can be associated with the reduced occurrence of arcs. The current-carrying capability of the vacuum switching path is reduced accordingly. A high current-carrying capability of the arrangement according to the invention is achieved by means of the rated-current contact switching path, which has a lower contact resistance in the closed state.

The at least one rated-current contact switching path, particularly the at least one rated-current contact, can be arranged around the at least one vacuum switching path, particularly around the at least one vacuum tube. The at least one rated-current contact can thus be arranged concentrically around the at least one vacuum tube. This produces a compact layout of the arrangement according to invention, with a high current-carrying capability of the rated-current contact associated with a large conductive perimeter of the rated-current contact.

The at least one rated-current contact switching path, in particular the at least one rated-current contact, can be spatially arranged essentially in parallel with at least one vacuum switching path, in particular with at least one vacuum tube. The at least one rated-current contact switching path, in particular the at least one rated-current contact, can be arranged such that it is not or does not become spatially enclosed by the at least one vacuum switching path, in particular by the at least one vacuum tube. Accordingly, the vacuum tube can be executed e.g. with a large perimeter, without dictating the perimeter of the rated-current contact. The rated-current contact can assume any shapes required, e.g. a round or rectangular bar shape, with no necessity for the assumption of a hollow shape in order to accommodate the vacuum tube.

The rated current can be at least partially conducted via elements of the at least one vacuum switching path, particularly via metallic elements of a vacuum tube. A housing of a vacuum tube can comprise two halves, each having a cylindrical insulator. The two halves can be joined together by means of a conductive region in the form of at least one connecting element, e.g. by means of a metal element, particularly of a cylindrical shape, which is bonded to the two halves in a vacuum-tight manner. The connecting element can assume e.g. a floating potential and/or can be connected to shielding for the contact points in the vacuum. In the closed state of the arrangement according to the invention, the rated-current contact points of a rated-current contact can be electrically connected via the connecting element. The contact points of the vacuum tube are in contact with one another in the vacuum, and are spatially enclosed by the connecting element, which functions as part of the housing of the vacuum tube. Particularly in the event of rated-current contact points of a hollow cylindrical shape, and a connecting element of a hollow cylindrical shape, the rated-current contact points, in the closed state, can be displaced by opposing sides of the hollow cylinder of the connecting element over said connecting element, and brought into electrical contact with the connecting element, in particular by means of contact fingers on the rated-current contact points.

A drive can be particularly connected via a kinematic chain to moveable contact points of the at least one vacuum switching path and to moveable contact points of the at least one rated-current contact switching path, in particular such that, during an opening process, the at least one rated-current contact is separated temporally in advance of the at least one contact of the vacuum tube and/or, during a closing process, the at least one rated-current contact is connected temporally after the at least one contact of the vacuum tube. Accordingly, the rated-current contact, in the closed state of the arrangement according to the invention, can essentially conduct the rated current, particularly in the event of a lower resistance across the rated-current contact than across the vacuum tube. During closing and opening, short-circuit currents occur, particularly prior to the connection or after the separation of the rated-current contact, which can flow via the vacuum tube in a short-term manner. Upon the separation or connection of the contact of the vacuum tube, arcs can occur, which are suppressed or quenched by the vacuum and by the optimization of the contact points of the vacuum tube, e.g. with respect to shape, material and/or motion profile. Rated-current contacts can be optimized for a low-loss conduction of the rated current, e.g. with a low resistance. The vacuum switching path, in particular the vacuum tube, can be optimized for the suppression of arcs, and for the simple and rapid interruption and/or connection, particularly of short-circuit currents.

The arrangement according to the invention for the switching of currents can be employed in high-, medium- and/or low-voltage engineering.

By a method according to the invention for switching high currents in low-, medium- and/or high-voltage engineering, particularly by means of an above-mentioned arrangement, a current path for a rated current is routed via at least one rated-current contact of a rated-current contact switching path, and a current path for a short-circuit current is routed in parallel via at least one contact of a vacuum tube of a vacuum switching path.

During an opening process, the at least one rated-current contact can be separated temporally in advance of the at least one contact of a vacuum tube, wherein the current, for such time as the at least one contact of the vacuum tube is still closed, is commutated to the at least one contact of the vacuum tube.

During a closing process, the at least one rated-current contact can be connected temporally after the at least one contact of a vacuum tube, wherein the at least one rated-current contact is not closed until a current flows via the at least one closed contact of the vacuum tube.

Via the at least one vacuum switching path, in particular the vacuum tube, a greater contact resistance can be constituted, with the contact closed, than via the at least one rated-current contact switching path, in particular via the rated-current contact.

A closed current path of the rated-current contact can be routed in particular via metallic elements of the at least one vacuum switching path, in particular elements of the housing of the vacuum tube. These elements of the housing can be connecting elements or a connecting element, in particular for the connection of insulating parts, particularly insulating halves of the housing of the vacuum tube.

The advantages of the method according to the invention for switching high currents in low-, medium- and/or high-voltage engineering, particularly by means of an above-mentioned arrangement, are analogous to the advantages of the above-mentioned arrangement according to the invention for switching high currents, and vice versa.

Exemplary embodiments of the invention are schematically represented in FIGS. 1 to 5 hereinafter, and are described in greater detail below.

DETAILED DESCRIPTION OF THE INVENTION

Figure 1:
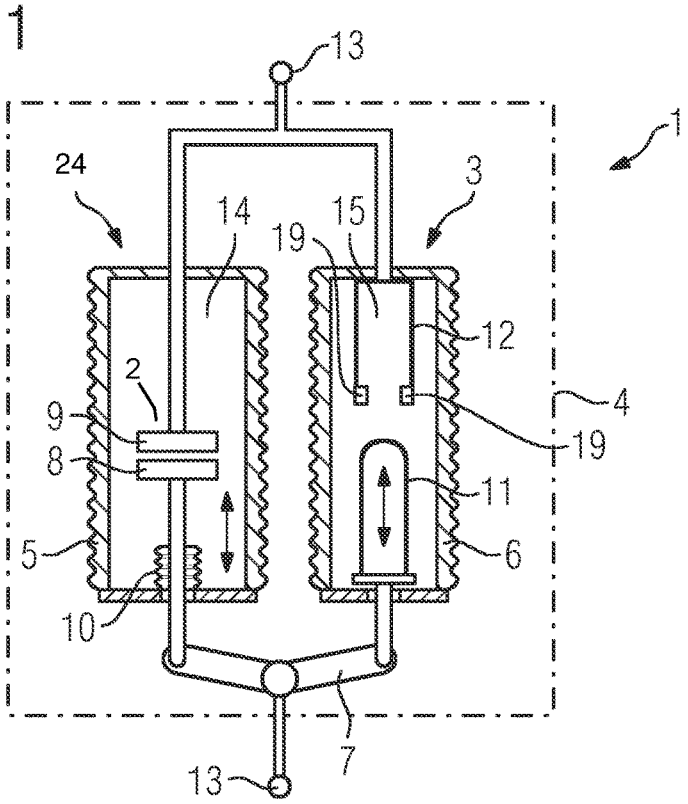
FIG. 1 shows a schematic sectional view of an arrangement 1 according to the invention for switching high currents, considered from one side, having a vacuum tube 2 which is spatially arranged essentially in parallel with an electrically parallel-connected rated-current contact 3.

FIG. 1 shows a schematic sectional representation of an arrangement 1 according to the invention for switching high currents, particularly in high-, medium- and/or low-voltage engineering. The arrangement 1 comprises a vacuum switching path 24 in the form of a vacuum tube 2 and a rated-current contact switching path in the form of a rated-current contact 3. The vacuum tube 2 and the rated-current contact 3 are electrically connected in parallel. This parallel circuit is externally connected via electrical contacts 13 e.g. to a voltage grid, wherein the arrangement 1 establishes or interrupts a current flow between the contacts 13.

The vacuum tube 2 and the rated-current contact 3, which are essentially arranged in parallel with one another, are spatially separated by means of mutually separated gas-insulated insulating housings 5, 6. The interior of the vacuum tube 2 is evacuated. The interior of the housing 6 of the rated-current contact 3 is filled e.g. with clean air or with another switching gas, particularly $SF_6$. The arrangement 1 can comprise an external housing 4, in which the vacuum tube 2 and the rated-current contact 3 are enclosed, e.g. in order to protect the latter against climatic influences. An external housing 4 can also be provided for the protection of specific elements only, e.g. elements of the kinematic chain, particularly the drive and/or the transmission 7, wherein the housings 5, 6 of the vacuum tube 2 and the rated-current contact 3 are configured as weatherproof insulating housings. The insulating housings are formed e.g. of silicon and/or a ceramic material, and are particularly configured with a ribbed design, in order to prevent leakage currents via the external housing 5, 6.

The vacuum tube 2, which constitutes the vacuum switching path, comprises a contact having one fixed contact point 9 and one moveable contact point 8. The moveable contact point 8 is mounted in a moveable manner by means of a bellows 10, and is connected to the housing 5 in a fluid-tight manner. The fixed contact point 9 is connected to the housing 5 in a secure and fluid-tight manner, e.g. by soldering and/or welding. At their respective ends in the housing 5, the contact points 8, 9 are configured e.g. with a plate-shaped design, having mutually opposing flat base or top surfaces of a regular cylinder. The base or top surfaces can be provided with surface indentations or gaps, in particular with meander-shaped structures, which are configured for the conduction of arcs on the surface in the direction of the outer perimeter. Arcs generated during switching can be quenched in the edge region, i.e. at the outer perimeter of the base or top surfaces.

The rated-current contact 3, which constitutes the rated-current contact switching path, also comprises a contact having one fixed contact point 12 and one moveable contact point 11. The moveable contact point 11 is mounted in the housing 6 in a moveable manner, either directly or via a contact rod, and is connected to the housing 6 in a fluid-tight manner e.g. by means of a seal. The fixed contact point 12 is securely bonded to the housing 6, e.g. by soldering and/or welding, and the electrical contact thereof is brought out to the exterior e.g. in the form of a contact rod, particularly in a fluid-tight manner. The moveable contact point 11, in the exemplary embodiment represented in FIG. 1, is configured as a cylindrical rod or bolt. The fixed contact point 12, in the exemplary embodiment represented in FIG. 1, is configured as a tulip contact. In the electrically closed state of the contact, the tulip contact 12 spatially encloses the cylindrical bolt 11 at the outer perimeter of said bolt 11. Contact fingers 19 at the end of the fixed contact point 12, particularly in the form of leaf springs, can be provided for the constitution of good electrical contact with the moveable contact point 11 in the electrically closed or connected state.

Alternatively, the moveable contact point 11 can be configured as a tulip contact, and the fixed point 12 can be configured as a contacts rod or bolt, although this is not represented in the figures, in the interests of simplicity. The housings 5, 6 and the contacts 8, 9, 11, 12 assume e.g. a regular cylindrical shape. In an electrically closed state of the contacts, the contact points 8, 9 of the vacuum tube 2, in the interests of good electrical contact with the opposing base or top surfaces, are compressed together, and the contact point 11 of the rated-current contact 3 is inserted into the contact point 12 in a form-fitted manner.

A movement of the moveable contact points 8, 11 is executed by means of elements of a kinematic chain, e.g. which is driven by a drive, in particular a stored-energy spring drive. Upon switching, the movement of the drive is transmitted via elements of the kinematic chain, in particular a transmission and drive rods, to the contact points 8, 11. In the figures, the transmission 7 is represented schematically only, by way of an example. In the transmission 7, the transmission of movement to the contact point 8 of the vacuum tube 2 and the contact point 11 of the rated-current contact 3 is executed with a temporal offset such that, upon closing, the contact of the vacuum tube 2 is closed first, and the contact of the rated-current contact 3 is closed thereafter. Upon opening, the contact of the rated-current contact 3 is separated first, and the contact of the vacuum tube 2 is separated temporally thereafter. Alternatively, the contacts 2, 3 can also be opened and/or closed simultaneously.

The transmission can comprise levers and shafts, and/or transmission elements such as gear wheels which, in the interests of simplicity, are not represented in the figures. Electrical contact connection of the moveable contact points 8, 11 with the external electrical contact 13 can be executed by means of elements of the transmission 7 and/or the respective drive rod.

Figure 2:
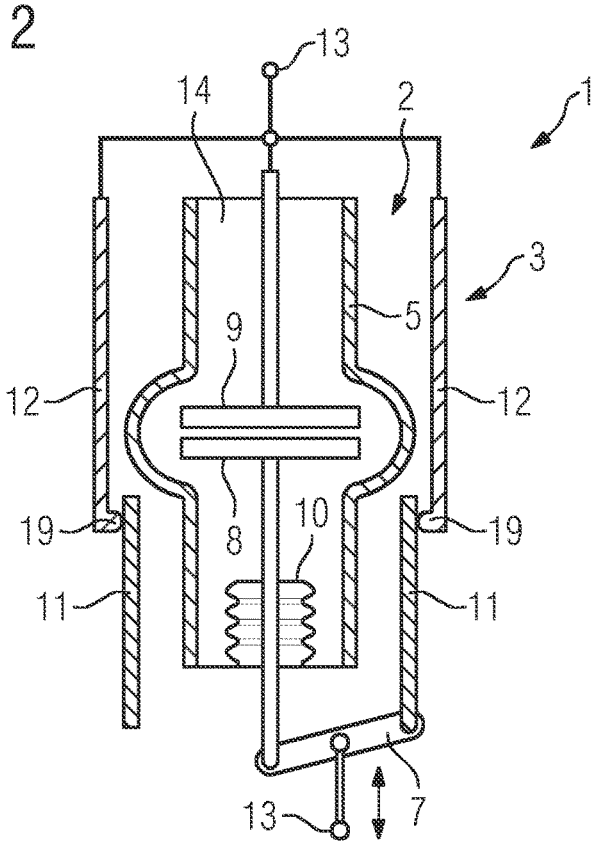
FIG. 2 shows a schematic sectional view of the arrangement 1 according to FIG. 1, wherein the electrically parallel-connected rated-current contact 3 is spatially arranged concentrically around the vacuum tube 2.

FIG. 2 shows a schematic sectional representation of the arrangement 1 according to FIG. 1, wherein the electrically parallel-connected rated-current contact 3 is not spatially arranged in parallel with the vacuum tube 2, adjacently to said vacuum tube 2, but is spatially arranged concentrically around the vacuum tube 2. The rated-current contact 3 is configured in the shape of a hollow tube or a hollow cylinder, wherein the vacuum tube 2 is arranged in the hollow cylinder. In FIG. 2, the arrangement 1 according to the invention is represented with an electrically closed rated-current contact 3 and an open contact of the vacuum tube 2. Such a positioning of the contact points 8, 9, 11, 12 in relation to one another occurs upon the opening of the electrical contact of the arrangement 1. The vacuum tube 2 arranged in the rated-current contact 3 is configured with a spacing to the rated-current contact points 11, 12, i.e. the housing 5 of the vacuum tube 2 does not engage in mechanical contact with the contact points 11, 12 of the rated-current contact 3.

By way of distinction from the exemplary embodiment according to FIG. 1, the arrangement 1 according to FIG. 2 comprises no bar-shaped moveable rated-current contact point 11 or no bolt 11 as a rated-current contact point 11, but both contact points 11, 12 of the rated-current contact 3 are configured with a hollow interior. At least one contact point 11 or 12 of the rated-current contact 3 can comprise contact fingers 19. Upon the movement of the moveable contact point 11, associated with closing, the contact fingers 19, in particular leaf spring-shaped contact fingers, of the contact point 12 are pushed onto the cylindrical contact point 11, for the constitution of good electrical and mechanical contact.

The transmission 7 for transmitting a temporally offset movement to the contact points 8, 11 is shown in a simplified representation in FIG. 2. By means of a lever 7, the drive force, particularly of a drive such as e.g. a stored-energy spring drive, upon closing, is firstly transmitted to the moveable contact point 8 of the vacuum tube 2, and temporally thereafter to the moveable contact point 11 of the rated-current contact 3, particularly with a time interval ranging from milliseconds to seconds. Different motion profiles of the contact points 8 and 11 can also be generated, with a higher speed of movement of the contact point 8 in relation to the contact point 11. Alternatively or additionally, the distances between the contact points 8 and 9, and 11 and 12, in the open state, can be differently selected, in particular with a greater distance between the contact points 11 and 12 than between the contact points 8 and 9.

The electrical contact of the vacuum tube 2 is closed first, and the electrical contact via the rated-current contact 3 is closed temporally thereafter. During opening, this sequence is reversed. By means of the lever 7, the drive force is firstly transmitted to the moveable contact point 11 of the rated-current contact 3, and temporally thereafter, in particular with a time interval ranging from milliseconds to seconds, to the moveable contact point 8 of the vacuum tube 2. Electrical contact via the rated-current contact 3 is opened first, and the electrical contact of the vacuum tube 2 is opened temporally thereafter.

Figure 3:
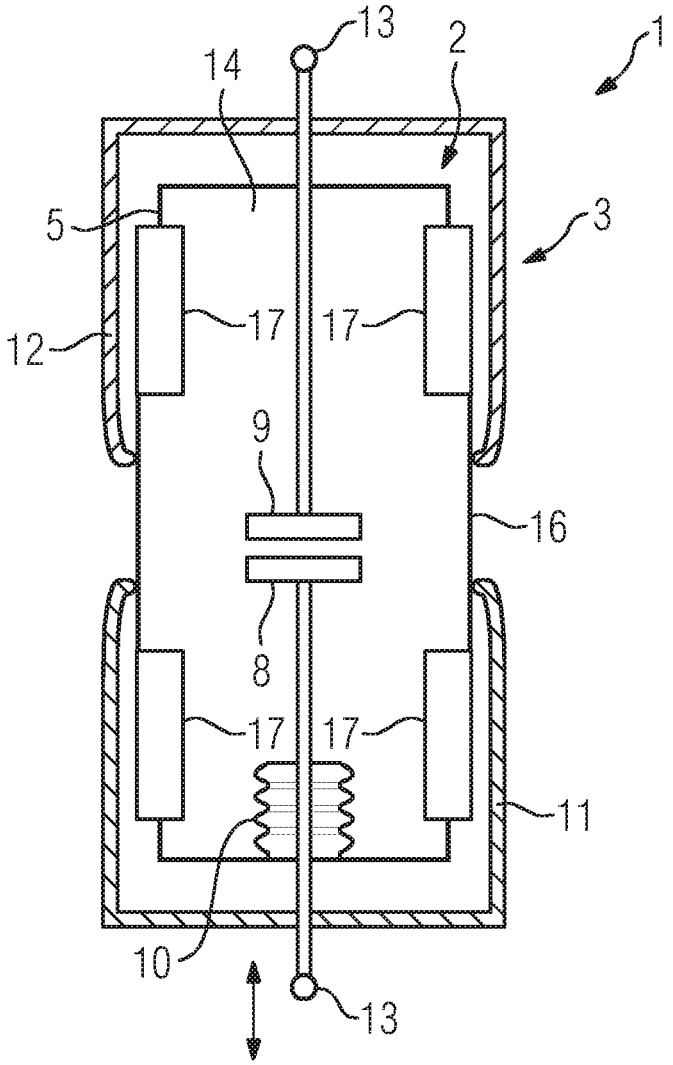
FIG. 3 shows a schematic sectional view of the arrangement 1 according to FIG. 2, having an electrically conductive connecting element 16 as part of a housing 5 of the vacuum tube 2 which, in the closed state, electrically connects the rated-current contacts 11.

FIG. 3 shows a schematic sectional representation of the arrangement 1 according to FIG. 2 but, by way of distinction from the exemplary embodiment according to FIG. 2, having an electrically conductive connecting element 16 as part of a housing 5 of the vacuum tube 2 which, in the closed state, electrically connects the rated-current contact points 11 and 12. In the interests of simplicity, no drive and/or transmission 7 is represented in FIG. 3. The length of the contact points 8, 9, 11, 12 can be selected such that the contacts of the vacuum tube 2 and the rated-current contact 3 close and/or open simultaneously or in a close sequence. Alternatively, a transmission 7 which is analogous to the transmission 7 in FIGS. 1 and 2 can be employed.

Figure 4:
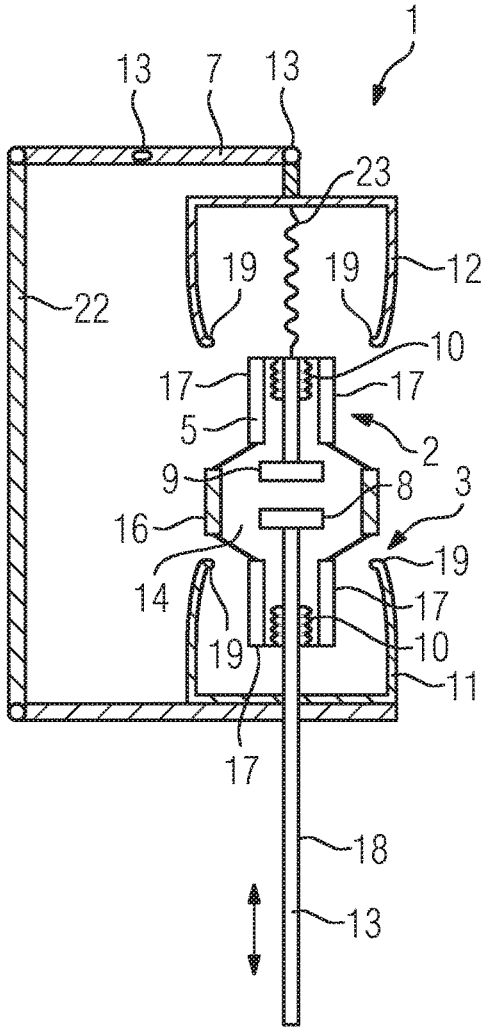
FIG. 4 shows a schematic sectional view of the arrangement 1 according to FIG. 3, having two moveable rated-current contacts 11, which are interconnected by means of a corner gear transmission 7 having insulating rods 22, in an electrically open state.
Figure 5:
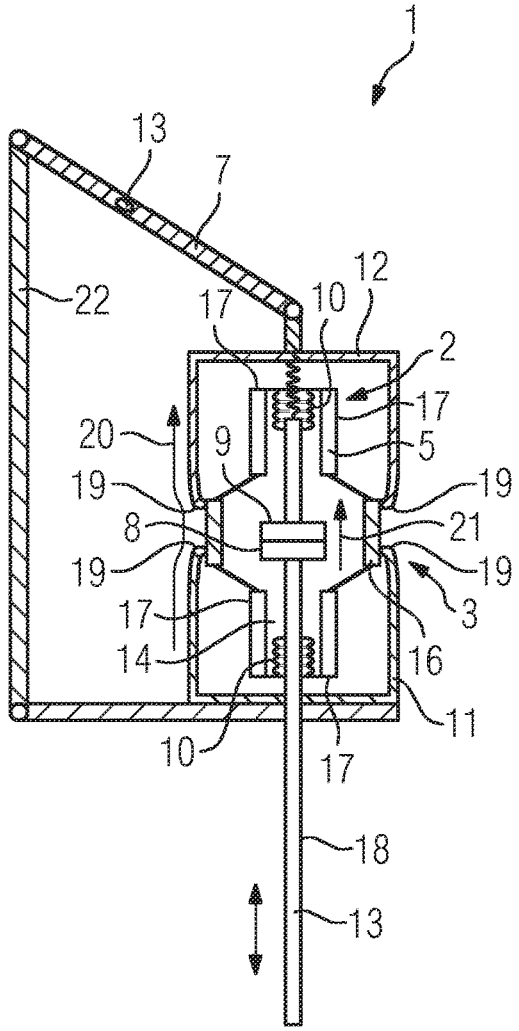
FIG. 5 shows a schematic sectional view of the arrangement 1 according to FIG. 4, in an electrically closed state.

FIGS. 4 and 5 show a schematic sectional representation of the arrangement 1 according to FIG. 3, having a corner gear transmission 7. The corner gear transmission 7 comprises a lever which is mounted e.g. on a shaft and which e.g. is essentially centrally rotatably mounted, at one end of which a moveable contact point 12 is fastened, and at the other end of which an insulating rod 22 is fastened. The insulating rod 22 is mechanically connected to a second contact point 11 of the rated-current contact 3 via elements of the kinematic chain, e.g. a rod, and is specifically fastened thereto, and is connected to a drive rod 18.

The open state is represented in FIG. 4. The contact points 8, 9 of the vacuum tube 2 are separated from one another, and the contact points 11 and 12 of the rated-current contact 3 are likewise electrically separated from one another, and are mechanically and electrically separated from the connecting element 16. A current flow via the arrangement 1 according to the invention is not possible, as the electrical contact via the arrangement 1 is interrupted.

The closed state is represented in FIG. 5. The contact points 8, 9 of the vacuum tube 2 are compressed against one another, or are electrically and mechanically mutually connected. The contact points 11 and 12 of the rated-current contact 3 are electrically connected by means of the connecting element 16. In particular, the contact points 11 and 12 are respectively provided with contact fingers 19, and the latter are mechanically and electrically connected to the connecting element 16. The connecting element 16 and the contact points 11 and 12 of the rated-current contact 3 are configured with a hollow cylindrical shape, wherein the connecting element 16 e.g. assumes a smaller diameter than the rated-current contact points 11 and 12. The rated-current contact points 11 and 12, in particular having contact fingers 19 at the respective ends thereof, are pushed from both sides over one end of the connecting element 16 respectively, such that good electrical contact is constituted between the connecting element 16 and the two rated-current contact points 11, 12.

Accordingly, the connecting element 16, which constitutes part of the housing 5 of the vacuum tube 2, also forms part of the rated-current contact 3, comprising the two moveable rated-current contact points 11, 12 and the connecting element 16. In the closed state, a rated current essentially flows via the rated-current contact 3, i.e. via the two moveable rated-current contact points 11, 12 and the connecting element 16. By the selection of material, e.g. copper, aluminum or steel, and by means of the large perimeter, and thus the large conductive surface, associated with the cylindrical shell of the rated-current contact points 11 and the connecting element 16, the rated-current contact 3 shows a lower electrical resistance than that of the contact via the vacuum tube 2. In the closed state, a higher rated current 20, up to the order of a few hundred amperes, can flow via the rated-current contact 3.

By the selection of materials, e.g. combinations of copper, aluminum or steel, in particular a drive rod 18 of steel and plate-shaped ends of the contact points 8, 9 of copper, or all elements, such as the drive rod 18 and the contact points 8, 9 of steel, and/or by means of the smaller diameter of the contact points 8, 9 in comparison with the perimeter of the rated-current contact points 11 and 12, a greater resistance or contact resistance is permitted via the contact of the vacuum tube 2 than via the rated-current contact 3. Accordingly, with the contact of the arrangement 1 closed, i.e. with a closed contact of the vacuum tube 2 and a closed rated-current contact 3, current is commutated to the rated-current contact 3. A current essentially flows via the rated-current contact 3. In the closed state, high currents 20, 21, up to the order of a few hundred amperes, can be accommodated by the arrangement 1 according to the invention.

Upon the opening of the electrical contact of the arrangement 1, starting from the situation according to FIG. 5, with the contacts closed, the rated-current contact 3 is separated first. The moveable rated-current contact points 11, 12 are withdrawn from the connecting element 16, such that mechanical and electrical separation is executed. The entire current 21 flows via the contact of the vacuum tube 2. The higher electrical resistance of the vacuum tube 2 limits the current 21, in particular a short-circuit current, and restricts the occurrence and/or the prolonged burning of arcs upon the separation of the contact points 8, 9 of the vacuum tube 2. The separation of the contact points 8, 9 of the vacuum tube 2 occurs temporally after the separation of the rated-current contact points 11, 12. As a result, the occurrence of arcs upon the separation of the rated-current contact points 11, 12 is prevented or substantially reduced.

Further to the separation of the contact points 8, 9 of the vacuum tube 2, electrical contact via the arrangement 1 according to the invention is interrupted, and a flow of current via the contact points 8, 9, 11, 12 is suppressed. In the exemplary embodiment according to FIGS. 3 and 4, all the contact points 8, 9, 11, 12 are moveable. In FIG. 5, the movement of the contact point 8 and of the contact point 11, in particular, is directly driven by means of the drive rod 18, wherein the contact point 8 and the contact point 11 are permanently attached to the drive rod 18.

A movement of the contact point 9 and of the contact point 12 in FIG. 5 is executed by means of a bell crank, which functions as a transmission 7, connected to the insulating rod 22, which is permanently attached to the drive rod 18. Upon a movement of the drive rod 18 which, in particular, is directly transmitted to the contact point 8 and the contact point 11, the insulating rod 22 is moved in the same direction. The bell crank 7, at one end of which the insulating rod is fastened and at the other end of which the contact point 9 and the contact point 12 are fastened, executes a movement of the contact point 9 and the contact point 12 in the opposing direction, particularly in opposition to the direction of movement of the contact point 8 and the contact point 11.

The contact points 8, 11 and the contact points 9, 12 are moved in opposition in relation to each other, towards each other upon closing and away from each other upon opening. A spring element 23 between the contact point 12 and the contact point 9 can execute a time delay in the closing of the rated-current contact 3 in relation to the closing of the contact 3 of the vacuum tube 2, and a time delay in the opening of the contact 3 of the vacuum tube 2 in relation to the opening of the rated-current contact 3. Alternatively, the contact point 9 can be stationarily arranged in the vacuum tube 2, and the contact of the vacuum tube 2 only opened and/or closed by the movement of the contact point 8. The contact points 11, 12 are both moved by means of the drive rod, the contact point 11 in particular in a direct manner, and the contact point 12 via the insulating rod 22 and the lever 7 in an opposing direction and with a temporal delay. Electrical contact between the contact point 12 and the contact point 9 can be executed by means of the spring element 23 or a cable.

In the open state of the contacts 2 and 3, the contact points 8 and 9 and the contact points 11 and 12 are respectively electrically insulated from each other by means of the insulating rod 22. The spatial clearance of the contact points 8 and 9, and the insulators 17 of the housing 5 of the vacuum tube 2, and the spatial clearance of the contact points 11, 12 from each other and from the connecting element 16, insulate the external electrical contacts 13 from each other on opposing sides of the arrangement 1 according to the invention. The connecting element 16, which is spatially arranged in the housing 5, in particular between two hollow cylindrical insulators 17, assumes a floating potential.

In the closed state of the contacts 2 and 3, the contact points 8, 9 and the contact points 11, 12 are respectively electrically interconnected by means of the connecting element 16. By the parallel electrical connection of the contacts 2 and 3, all the contact points 8, 9, 11, 12 and the connecting element 16 essentially assume an equal potential, and electrical flashover from the connecting element 16 to the contact points 8 and 9 cannot occur.

The above-mentioned exemplary embodiments can be mutually combined and/or can be combined with the prior art. Accordingly, e.g. different transmissions 7 and combinations of stationary and moveable contact points can be employed. The rated-current contact 3 and the contact of the vacuum tube 2, rather than in a temporal sequence, can also be opened and/or closed simultaneously. The vacuum tube 2 and the rated-current contact points 11, 12 can assume a different structure, in particular a hollow cylindrical shape or e.g. a quadratic cross-section. The arrangement 1 can comprise an external housing 4, in particular filled with an insulating gas, e.g. clean air or $SF_6$. Alternatively, depending upon the form of embodiment, components can be arranged in different housings 5, 6. A proportion of a rated current, or exclusively a short-circuit current, can also flow via the vacuum tube 2. In the latter case, essentially the entire rated current, in the closed state, can flow via the rated-current contact 3.

In the contact region, the contact points 8, 9, 11, 12 can be coated, e.g. with silver, in the interests of improved conductivity via the contact. The contact points 8, 9 can also be coated with an erosion-resistant material and, particularly as an alternative to a silver coating, can be coated with a poorly conductive material, which suppresses arcing and/or prevents or reduces the melting of the contact points 8, 9. The contact points 8, 9 can assume a cup shape and/or a plate shape, particularly with surface structures such as e.g. meander-shaped or star-shaped indentations, for the conduction of arcs. The rated-current contact points 11, 12 and/or the connecting element 16 or connecting elements 16 can assume regular cylindrical cross-sections, or e.g. cross-sections of an elliptical or rectangular shape.

LIST OF REFERENCE NUMBERS

1 Arrangement for switching high currents
2 Vacuum tube
3 Rated-current contact
4 External housing of arrangement
5 Vacuum tube housing
6 Rated-current contact housing
7 Transmission
8 Moveable contact point of vacuum tube
9 Stationary or likewise moveable contact point of vacuum tube
10 Bellows
11 Moveable rated-current contact point
12 Stationary or likewise moveable rated-current contact point
13 Electrical contact
14 Vacuum
15 Gas, e.g. clean air
16 Connecting element
17 Insulator
18 Drive rod
19 Contact finger
20 Flow of rated current
21 Flow of short-circuit current/rated current
22 Insulating rod
23 Spring element

The invention claimed is:

1. An arrangement for switching high currents, the arrangement comprising:

at least one vacuum switching path including at least one vacuum tube and at least one rated-current contact switching path including at least one rated-current contact;

said at least one rated-current contact switching path having a rated current, said at least one vacuum switching path having metallic elements of said at least one vacuum tube, and said rated current being partially conducted by said metallic elements of said at least one vacuum switching path;

mutually separated gas-insulated insulating housings spatially separated from said at least one vacuum tube and said at least one rated-current contact and separating said at least one vacuum tube and said at least one rated-current contact from each other; and said at least one vacuum switching path and said at least one rated-current contact switching path being electrically connected in parallel.

2. The arrangement according to claim 1, wherein said at least one rated-current contact is a cylindrical rated-current contact having at least two contact points, wherein at least one contact point is disposed in a moveable manner.

3. The arrangement according to claim 1, wherein said rated-current contact is at least one of formed of a metal or incorporates a metal.

4. The arrangement according to claim 3, wherein said metal is aluminum, steel, copper, silver or metallic alloys incorporating at least one of aluminum, steel, copper or silver.

5. The arrangement according to claim 1, wherein said at least one rated-current contact switching path has a lower contact resistance than said at least one vacuum switching path.

6. The arrangement according to claim 1, wherein said at least one rated-current contact switching path or said at least one rated-current contact is disposed around said at least one vacuum switching path or around said at least one vacuum tube.

7. The arrangement according to claim 6, wherein said at least one rated-current contact is disposed concentrically around said at least one vacuum tube.

8. The arrangement according to claim 1, wherein said at least one rated-current contact switching path or said at least one rated-current contact is spatially disposed in parallel with said at least one vacuum switching path or with said at least one vacuum tube.

9. The arrangement according to claim 1, wherein:

said at least one vacuum switching path has moveable contact points;

said at least one rated-current contact switching path has moveable contact points; and a drive is connected to said moveable contact points.

10. The arrangement according to claim 9, which further comprises a kinematic chain connected between said drive and said moveable contact points.

11. The arrangement according to claim 9, wherein said drive is configured for at least one of:

separating said at least one rated-current contact temporally in advance of said at least one contact of said vacuum tube during an opening process, or connecting said at least one rated-current contact temporally after said at least one contact of said vacuum tube during a closing process.

12. The arrangement according to claim 1, wherein the arrangement is configured for switching currents in at least one of high-voltage, medium-voltage or low-voltage engineering.

13. A method for switching high currents in at least one of low-voltage, medium-voltage or high-voltage engineering, the method comprising the following steps:

routing a current path for a rated current through at least one rated-current contact of a rated-current contact switching path;

routing a current path for a short-circuit current through at least one contact of a vacuum tube of a vacuum switching path;

using mutually separated gas-insulated insulating housings separated from the vacuum tube and the at least one rated-current contact to spatially separate the at least one contact of the vacuum tube and the at least one rated-current contact from each other;

connecting the current path for the rated current and the current path for the short-circuit current in parallel; and providing the at least one rated-current contact switching path with a rated current, providing the vacuum switching path with metallic elements of the at least one vacuum tube, and using the metallic elements of the vacuum switching path to partially conduct the rated current.

14. The method according to claim 13, which further comprises:

separating the at least one rated-current contact temporally in advance of the at least one contact of the vacuum tube during an opening process; and commutating the current to the at least one contact of the vacuum tube for such time as the at least one contact of the vacuum tube is still closed.

15. The method according to claim 14, which further comprises:

connecting the at least one rated-current contact temporally after the at least one contact of the vacuum tube during a closing process; and only closing the at least one rated-current contact when a current flows through the at least one closed contact of the vacuum tube.

16. The method according to claim 13, which further comprises providing a greater contact resistance with the contact closed through the at least one vacuum switching path or the vacuum tube than through the at least one rated-current contact switching path or the rated-current contact.

17. The method according to claim 13, which further comprises routing a closed current path of the rated-current contact through elements of the at least one vacuum switching path.

18. The method according to claim 13, which further comprises carrying out the step of using the metallic elements of the vacuum switching path to partially conduct the rated current by routing a closed current path of the rated-current contact through the metallic elements being part of the housing of the vacuum tube.

* * * * *